US009005317B2

(12) United States Patent
Yamamoto et al.

(10) Patent No.: US 9,005,317 B2
(45) Date of Patent: Apr. 14, 2015

(54) METHOD FOR PRODUCING SOLID FUEL AND SOLID FUEL PRODUCED BY THE METHOD

(75) Inventors: Seiichi Yamamoto, Takasago (JP); Takuo Shigehisa, Takasago (JP); Yutaka Mitou, Takasago (JP); Satoru Sugita, Takasago (JP); Yuko Sugita, legal representative, Kobi (JP); Shigeru Kinoshita, Takasago (JP)

(73) Assignee: Kobe Steel, Ltd, Kobe-shi (JP)

( * ) Notice: Subject to any disclaimer, the term of this patent is extended or adjusted under 35 U.S.C. 154(b) by 661 days.

(21) Appl. No.: 13/120,369

(22) PCT Filed: Sep. 29, 2009

(86) PCT No.: PCT/JP2009/066927

§ 371 (c)(1),
(2), (4) Date: Apr. 1, 2011

(87) PCT Pub. No.: WO2010/041572

PCT Pub. Date: Apr. 15, 2010

(65) Prior Publication Data

US 2012/0011766 A1 Jan. 19, 2012

(30) Foreign Application Priority Data

Oct. 9, 2008 (JP) ..... 2008-262513

(51) Int. Cl.
*C10L 5/06* (2006.01)
*C10L 5/02* (2006.01)
(Continued)

(52) U.S. Cl.
CPC ... *C10L 9/10* (2013.01); *C10L 5/04* (2013.01); *C10L 5/32* (2013.01); *C10L 5/361* (2013.01)

(58) Field of Classification Search
USPC ..... 44/608, 626, 592
See application file for complete search history.

(56) References Cited

U.S. PATENT DOCUMENTS 4,185,395 A 1/1980 Nakako et al.
4,705,533 A 11/1987 Simmons
(Continued)

FOREIGN PATENT DOCUMENTS

CN 1108684 A 9/1995
JP 53 112902 10/1978
(Continued)

OTHER PUBLICATIONS

U.S. Appl. No. 13/290,466, filed Nov. 7, 2011, Sugita, et al.
(Continued)

*Primary Examiner* — Prem C Singh
*Assistant Examiner* — Chantel Graham
(74) *Attorney, Agent, or Firm* — Oblon, McClelland, Maier & Neustadt, L.L.P.

(57) ABSTRACT

Modified solid fuel manufacturing method and modified solid fuels manufactured using the manufacturing method. When solid fuels are manufactured by crushing low grade coal, mixing the crushed low grade coal with solvent oil to prepare a slurry, heating the slurry to at least the boiling point of water to evaporate moisture included in the slurry, separating the solvent oil from the slurry to produce charcoal dust and compression compacting said charcoal dust, by heating the slurry to at least the boiling point of water, the non-volatile components included in the low grade coal are extracted with the solvent oil, the outer surface of the low grade coal and the internal surfaces of the pores are coated with the extracted non-volatile components, and the content of heavy oil added from the outside will be less than 0.5 mass % relative to the solid fuel after drying.

17 Claims, 3 Drawing Sheets

(51) Int. Cl.

| | |
|---|---|
| ***C10L 9/10*** | (2006.01) |
| ***C10L 5/04*** | (2006.01) |
| ***C10L 5/32*** | (2006.01) |
| ***C10L 5/36*** | (2006.01) |

(56) References Cited

U.S. PATENT DOCUMENTS

| | | | | |
|---|---|---|---|---|
| 4,800,015 | A | 1/1989 | Simmons | |
| 5,556,436 | A * | 9/1996 | Yagaki et al. | 44/626 |
| 2005/0097814 | A1 * | 5/2005 | Sugita et al. | 44/620 |
| 2009/0255173 | A1 * | 10/2009 | Sugita et al. | 44/608 |

FOREIGN PATENT DOCUMENTS

| | | | |
|---|---|---|---|
| JP | 57 18794 | | 1/1982 |
| JP | 63 503461 | | 12/1988 |
| JP | 2776278 | | 5/1998 |
| JP | 10 158666 | | 6/1998 |
| JP | 2000 290673 | | 10/2000 |
| JP | 2005 139342 | | 6/2005 |
| JP | 2005139342 | * | 6/2005 |
| JP | 2005 206695 | | 8/2005 |
| JP | 2005-206695 | A | 8/2005 |
| JP | 2007-138103 | | 6/2007 |
| JP | 2007-138103 | A | 6/2007 |
| RU | 2012152898 | A | 12/2012 |
| WO | WO2007060852 | * | 5/2007 |

OTHER PUBLICATIONS

International Search Report Issued Dec. 15, 2009 in PCT/JP09/066927 filed Sep. 29, 2009.

U.S. Appl. No. 13/124,133, filed Apr. 14, 2011, Sugita, et al.

Australian Office Action issued Aug. 14, 2012, in Australia Patent Application No. 2009301710.

Office Action issued Sep. 13, 2012, in German Patent Application No. 11 2009 002 398.3 with English translation.

Office Action issued Feb. 26, 2013 in Chinese Application No. 200980139458.2 (With English Translation).

Japanese Office Action issued in corresponding Japanese Patent Application No. 2010-167295, dispatched Aug. 27, 2013 with English translation, 4 pp.

* cited by examiner

METHOD FOR PRODUCING SOLID FUEL AND SOLID FUEL PRODUCED BY THE METHOD

TECHNICAL FIELD

The present invention relates to a method for producing an improved solid fuel in which coal, in particular, low-rank coal, is used as a raw material; and an improved solid fuel produced by the method.

BACKGROUND ART

Solid fuel is suitably used as fuel for, for example, thermal power generation or the like.

At present, bituminous coal is used as fuel for thermal power generation. However, the output of bituminous coal has been increasing year after year and there is a concern about exhaustion of bituminous coal. Accordingly, effective use of low-rank coal serving as an alternative to bituminous coal is an urgent issue.

Low-rank coal has a low calorific value and a spontaneous combustion property and hence applications of low-rank coal are limited. As means for effectively using low-rank coal, an upgraded brown coal process (hereafter, referred to as UBC process) has been used. To date, several processes for improving low-rank coal have been developed. However, it is difficult to practically use most of these processes because of high temperature or high pressure processing condition, which results in high apparatus cost, or low-rank coal is chemically changed to produce waste water containing a large amount of pyrolytic substances, which results in high waste-water treatment cost.

The applicant of the present invention disclosed such a UBC process in which low-rank coal is used as a raw material and an oil mixture containing a heavy oil and a solvent oil is made to be present in pores of the low-rank coal to thereby provide a solid fuel in which the content of the heavy oil in weight percentage with respect to the coal having been dewatered is 0.5% to 30% (Patent Literature 1). In the solid fuel of Patent Literature 1, water in pores of low-rank coal is removed and a heavy oil is made to adhere to the inner surfaces of the pores to cover active sites. Thus, spontaneous combustion of low-rank coal is suppressed and a heavy oil is contained in low-rank coal to achieve a high calorie. By dissolving a heavy oil in a solvent oil to achieve a low viscosity, pores are sufficiently impregnated with the heavy oil and, as a result, active sites in the pores are covered and a high calorie is achieved.

Improved-coal powder is scarcely used without being processed, as fuel. In general, improved-coal powder is compacted into briquettes and the briquettes are transported to a consumption site (for example, a thermal power plant or the like). When such briquettes have a low strength, the briquettes are cracked or produce powder during transportation or during loading/unloading operations. Thus, in addition to loss of a portion of the product, there is a concern about the increase in the probability of spontaneous combustion. Accordingly, briquettes are required to have a high strength.

In addition, to reduce production cost and to reduce environmental load, the proportion of components added from the outside is desirably made as low as possible or made zero.

Patent Literature 1: Japanese Patent No. 2776278

DISCLOSURE OF INVENTION

Problems to be Solved by the Invention

The present invention has been accomplished in view of what is described above. An object of the present invention is to provide a method for producing an improved solid fuel in which production cost is reduced, environmental load is reduced, a high strength is achieved for transportation or the like, and spontaneous combustion is suppressed; and such an improved solid fuel.

Means for Solving the Problems

The inventors of the present invention have conducted thorough studies in view of the above-described object. As a result, the inventors have found that, by immersing low-rank coal in a high-temperature oil, not only water in the low-rank coal can be evaporated but also a nonvolatile component originally contained in the low-rank coal is extracted with the high-temperature oil and the component can function as an alternative to a heavy oil. Like a heavy oil, the component has a function of covering active sites in low-rank coal to suppress spontaneous combustion. Thus, the proportion of a heavy oil added from the outside can be reduced.

Further study has revealed a finding that, when the heavy oil does not adhere to the surfaces of pulverized low-rank coal, the adhesion between fine coal particles prior to briquetting is enhanced and the strength of briquetted solid matter can be enhanced.

The present invention has been accomplished on the basis of the finding. An aspect of the present invention is a method for producing a solid fuel, the method including: a step of pulverizing low-rank coal; a step of preparing a slurry by mixing the pulverized low-rank coal with a solvent oil; a step of evaporating water in the slurry by heating the slurry to a boiling point of water or more; a step of producing fine coal by separating the solvent oil from the slurry; and a step of briquetting the fine coal, wherein, by heating the slurry to the boiling point of water or more, a nonvolatile component contained in the low-rank coal is extracted with the solvent oil and the extracted nonvolatile component covers an outer surface of the low-rank coal and inner surfaces of pores of the low-rank coal, and a content of a heavy oil added from outside is made less than 0.5 mass %, preferably substantially 0 mass %, with respect to the solid fuel having been dried.

The present invention also provides a solid fuel produced by briquetting pulverized low-rank coal, wherein an outer surface of the low-rank coal and inner surfaces of pores of the low-rank coal are covered with a nonvolatile component contained in the low-rank coal, and a content of a heavy oil is less than 0.5 mass %, preferably substantially 0 mass %, with respect to the solid fuel.

Advantageous Effects of Invention

According to the present invention, a nonvolatile component originally contained in low-rank coal is dissolved with high-temperature oil and the component can function as an alternative to a heavy oil. Thus, the proportion of a heavy oil added from the outside can be reduced; production cost can be reduced; and adverse effects on the environment can be suppressed. Furthermore, according to the present invention, as described above, the proportion of a heavy oil added, the heavy oil degrading the adhesion between fine coal particles, can be reduced. As a result, the strength of briquetted solid matter can be enhanced.

Accordingly, the present invention can provide a method for producing an improved solid fuel in which production cost is reduced, environmental load is reduced, and the strength of the solid fuel is enhanced for transportation or the like; and an improved solid fuel produced by the method.

REFERENCE SIGNS LIST

Figure 1:
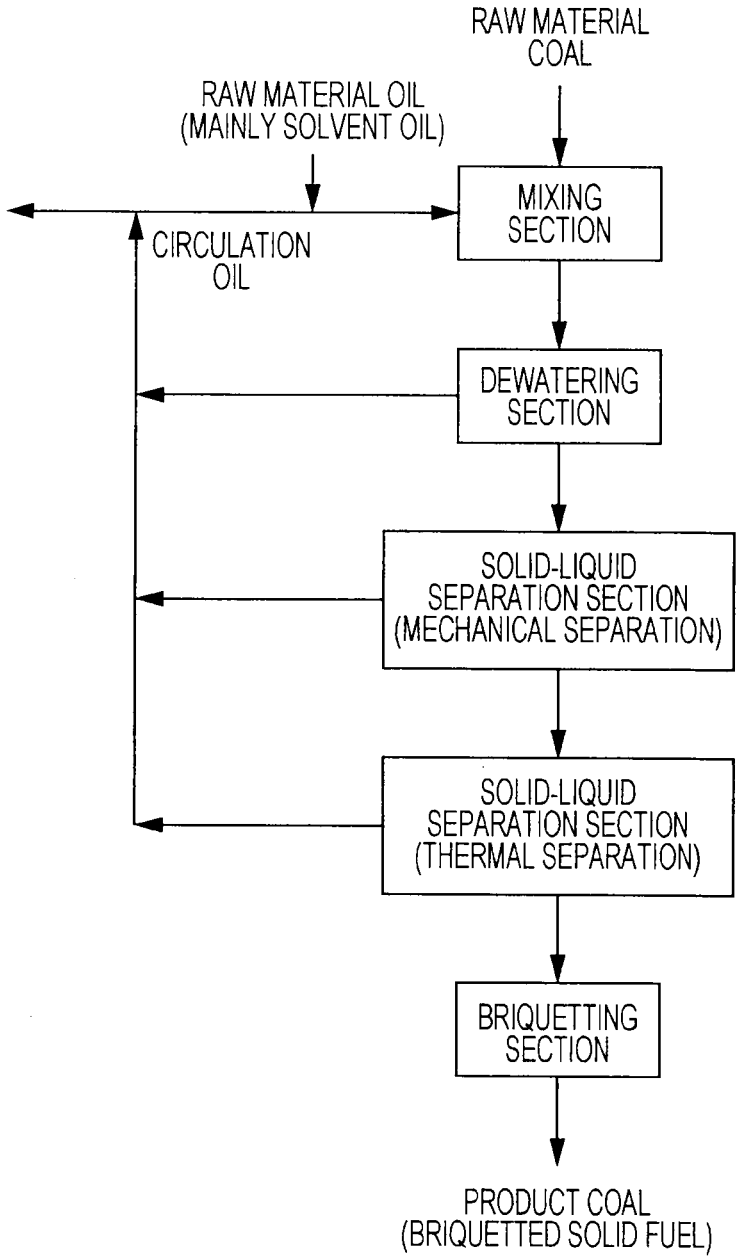
FIG. 1 illustrates a process flow of a method for producing an improved solid fuel according to the present invention.

1 mixing tank
2 pump
3 preheater
4 preheater
5 gas-liquid separator
6 pump
7 evaporator
8 compressor
9 oil-water separator
10 centrifugal separator
11 screw press
12 dryer
13 condenser
14 pump
15 cooler
16 heater

BEST MODES FOR CARRYING OUT THE INVENTION

Hereinafter, a method for producing an improved solid fuel according to the present invention and an improved solid fuel produced by the production method will be described in detail with reference to the drawings. However, embodiments described below are examples of the present invention and are not viewed as limiting the present invention. Note that common parts or components in the drawings are designated with like reference signs and redundant descriptions are omitted.

First Embodiment

A method for producing an improved solid fuel according to the present invention includes pulverizing low-rank coal; preparing a slurry by mixing the pulverized low-rank coal with a solvent oil; evaporating water in the slurry by heating the slurry to a boiling point of water or more; producing fine coal by separating the solvent oil from the slurry; and briquetting the fine coal, wherein, by heating the slurry to the boiling point of water or more, a nonvolatile component contained in the low-rank coal is extracted with the solvent oil and the extracted nonvolatile component covers an outer surface of the low-rank coal and inner surfaces of pores of the low-rank coal, and a content of a heavy oil added from outside is made less than 0.5 mass %, preferably substantially 0 mass %, with respect to the solid fuel having been dried (that is, in percentage with respect to the coal having been dewatered).

In a method for producing a solid fuel according to the present invention, an oil mixed with pulverized low-rank coal serves as a solvent oil; a nonvolatile component originally contained in the low-rank coal is extracted with the oil at a high temperature; and the nonvolatile component functions as an alternative to a heavy oil. Accordingly, the proportion of a heavy oil added from the outside can be reduced. In addition, although the amount of the heavy oil added is reduced, the nonvolatile component contained in the low-rank coal is used as the alternative and the nonvolatile component covers active sites in pores of the low-rank coal. Thus, spontaneous combustion can be suppressed as in the cases where the heavy oil is added. Furthermore, by a method for producing a solid fuel according to the present invention, the proportion of such a heavy oil added can be reduced, the heavy oil reducing the adhesion between fine coal particles. Thus, the strength of briquetted solid matter can be enhanced.

Figure 2:
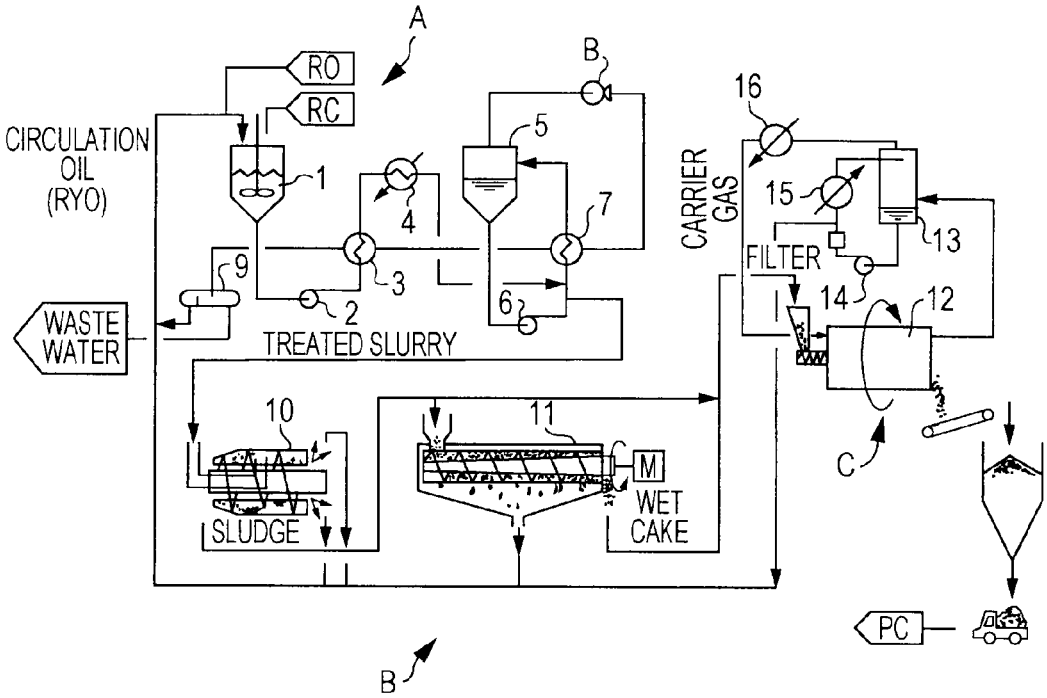
FIG. 2 is a schematic diagram illustrating an example of an apparatus for producing an improved solid fuel in which a method for producing an improved solid fuel according to the present invention is carried out.

FIG. 1 illustrates a process flow of a method for producing an improved solid fuel according to the present invention. A method for producing an improved solid fuel according to the present invention will be described in detail with reference to FIG. 1. FIG. 2 is a schematic diagram illustrating an example of an apparatus for producing an improved solid fuel in which a method for producing an improved solid fuel according to the present invention is carried out. A method for producing an improved solid fuel according to the present invention includes a low-rank coal pulverization and slurry preparation step; a dewatering step; a solid-liquid separation step; and a briquetting step. In addition, the method may further include a cooling step for cooling dried solid content between the solid-liquid separation step and the briquetting step.

The step of preparing a slurry of pulverized low-rank coal corresponds to a mixing section in the process flow in FIG. 1 and is conducted in a mixing tank 1 in the apparatus for producing an improved solid fuel in FIG. 2. The dewatering step corresponds to a dewatering section in the process flow in FIG. 1 and is conducted in an evaporator 7 and a gas-liquid separator 5 in the production apparatus in FIG. 2. The solid-liquid separation step corresponds to solid-liquid separation sections (mechanical separation and thermal separation) in the process flow in FIG. 1 and is conducted in a mechanical solid-liquid separator (centrifugal separator) 10, a screw press 11, and a dryer 12 in the production apparatus in FIG. 2. The briquetting step corresponds to a briquetting section in the process flow in FIG. 1 and is conducted in a briquetting device (not shown) in the production apparatus. The apparatus for producing an improved solid fuel in which a method for producing an improved solid fuel according to the present invention is carried out includes the mixing tank 1 in which an oil mixture containing a solvent oil is mixed with low-rank coal to prepare a raw material slurry; the evaporator 7 and the gas-liquid separator 5 in which the raw material slurry is subjected to a water evaporation treatment; the mechanical solid-liquid separator (centrifugal separator) 10, the screw press 11, and the dryer 12 in which the slurry having been subjected to the water evaporation treatment is subjected to solid-liquid separation; and the briquetting device (not shown) in which the dried solid fuel in the form of a powder is briquetted to produce a briquetted solid fuel.

Hereinafter, the steps will be described in detail.

1. Low-Rank Coal Pulverization and Slurry Preparation Step

As illustrated in FIGS. 1 and 2, low-rank coal serving as a raw material is pulverized and then supplied to the mixing section, that is, the mixing tank 1. The pulverized low-rank coal is mixed with an oil containing a solvent oil in the mixing tank 1 to prepare a raw material slurry. Various oils may be used as the solvent oil mixed with low-rank coal as long as a nonvolatile component contained in low-rank coal can be extracted with the oils. The solvent oil is preferably a light boiling oil in view of compatibility with a nonvolatile component and a heavy oil, ease of handling of a slurry, ease of entry into pores, and the like. In view of stability at a water evaporation temperature, the solvent oil is suitably a petroleum oil having a boiling point of 100° C. or more and preferably 400° C. or less. Examples of such a petroleum oil include kerosene, light oil, and heavy oil. Alternatively, coal liquid may be used. Preferably, kerosene can be used.

Although the solvent oil may contain a heavy oil, it is important that the amount of a heavy oil added by addition of an oil into the mixing tank 1 is adjusted such that the adhesion amount of the heavy oil in a solid fuel (that is obtained by subjecting a cake provided by solid-liquid separation to an oil evaporation treatment with a dryer) is less than 0.5 mass %, preferably substantially 0 mass %, with respect to low-rank coal (improved coal) having been dried in the solid fuel, that is, in percentage with respect to the coal having been dewatered.

As illustrated in FIG. 1, an oil and the like ejected from the dewatering section, the solid-liquid separation section (mechanical separation), and the solid-liquid separation section (thermal separation) may be circulated as a circulation oil to the mixing section. A solvent oil and a heavy oil may be added to the circulation oil. In this case, as in the above-described case, it is also important that the amount of a heavy oil added is adjusted such that the adhesion amount of the heavy oil in a solid fuel (that is obtained by subjecting a cake provided by solid-liquid separation to an oil evaporation treatment with a dryer) is less than 0.5 mass %, preferably substantially 0 mass %, with respect to low-rank coal (improved coal) having been dried in the solid fuel, that is, in percentage with respect to the coal having been dewatered.

In the present invention, the term "low-rank coal" denotes a coal that contains a large amount of water and is desirably dewatered, for example, a coal that has a water content of at least 20 mass % with respect to the coal having been dried. Naturally, such low-rank coal may contain high-rank coal or the like. Examples of such low-rank coal include brown coal, lignite, and subbituminous coal. Examples of brown coal include Victoria coal, North Dakota coal, and Beluga coal. Examples of subbituminous coal include West Banko coal, Binungan coal, and Samarangau coal. Low-rank coal is not restricted to the above-described examples and low-rank coal according to the present invention encompasses any coal that has a large water content and is desirably dewatered.

In the present invention, the term "nonvolatile component" denotes a nonvolatile oil that is originally contained in low-rank coal and, after being extracted, covers the outer surface of the low-rank coal and the inner surfaces of pores of the low-rank coal. Thus, the nonvolatile component covers active sites in pores of low-rank coal and hence suppresses spontaneous combustion. An example of such a nonvolatile component is an aromatic organic polymer compound.

In the present invention, the term "heavy oil" denotes a heavy fraction that substantially does not exhibit vapor pressure at, for example, 400° C., such as vacuum residual oil or an oil containing such a heavy fraction. As with the nonvolatile component, the heavy oil has a function of covering active sites in pores of low-rank coal and hence suppresses spontaneous combustion. Examples of such a heavy oil include petroleum asphalt, native asphalt, aliphatic organic polymer compounds, and aromatic organic polymer compounds.

In the present invention, the term "solvent oil" denotes an oil that can dissolve a heavy oil to reduce the viscosity of the heavy oil to thereby facilitate entry of the heavy oil into pores of low-rank coal, and that can extract a nonvolatile component contained in low-rank coal. Such a solvent oil can also dissolve a nonvolatile component to reduce the viscosity of the nonvolatile component to thereby facilitate entry of the nonvolatile component into pores of low-rank coal.

Figure 5:
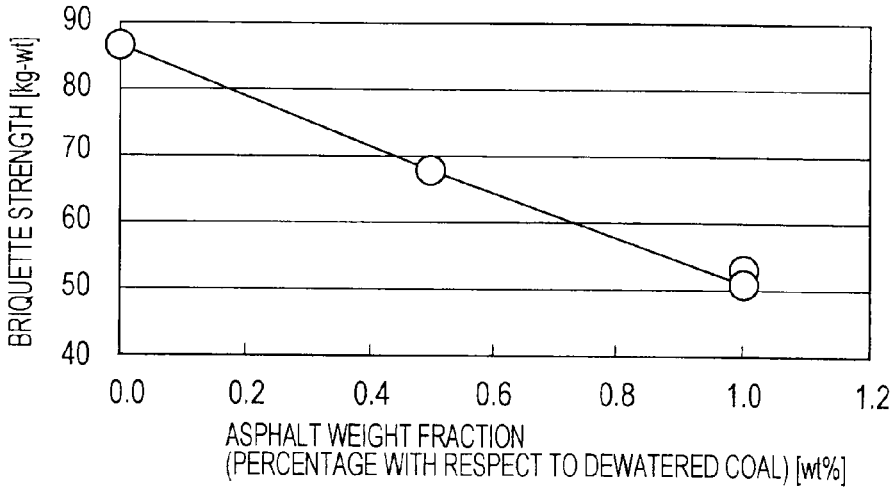
FIG. 5 is a graph illustrating the relationship between the mass fraction (percentage with respect to dewatered coal) [mass %] of a heavy oil (specifically, asphalt) and briquette strength [kg-wt].

However, when a solid fuel in the form of a powder is briquetted, such a heavy oil reduces the mechanical strength of the briquetted solid fuel. Accordingly, the amount of the heavy oil is preferably as small as possible. As described above, the amount of a heavy oil added is preferably adjusted such that the adhesion amount of the heavy oil in a solid fuel (that is obtained by subjecting a cake provided by solid-liquid separation to an oil evaporation treatment with a dryer) is less than 0.5 mass %, preferably substantially 0 mass %, with respect to low-rank coal (improved coal) having been dried in the solid fuel (in percentage with respect to the coal having been dewatered). FIG. 5 illustrates the relationship between the mass fraction (percentage with respect to dewatered coal) [mass %] of a heavy oil (specifically, asphalt) and briquette strength [kg-wt]. The abscissa axis indicates the mass fraction (percentage with respect to dewatered coal) [mass %] of a heavy oil (specifically, asphalt). The ordinate axis indicates briquette strength [kg-wt]. As illustrated in FIG. 5, by making the adhesion amount of a heavy oil in a solid fuel be 0 to 0.5 mass %, the strength of a briquetted solid fuel can be made about 68 kg-wt to about 87 kg-wt. In particular, when the adhesion amount is 0 mass %, the briquetted solid fuel has the highest strength of about 87 kg-wt, which is preferred. When a briquetted solid fuel produces powder, the probability of the contact between active sites of the solid fuel and the air increases and there is a concern about the increase in the probability of spontaneous combustion. However, as described above, when the strength of a briquetted solid fuel is increased by making the adhesion amount of a heavy oil be 0 to 0.5 mass %, spontaneous combustion can be suppressed.

The type of a mixing tank according to the present invention is not particularly restricted and various mixing tanks may be used. However, in general, an axial mixer or the like is preferably used.

In the low-rank coal pulverization and slurry preparation step, a raw material slurry can be prepared by mixing pulverized low-rank coal with an oil containing a solvent oil.

2. Dewatering Step

The thus-prepared raw material slurry is transported to preheaters 3 and 4 by a pump 2 and preheated with the preheaters 3 and 4. After that, the raw material slurry is heated with the evaporator 7. In the evaporator 7, dewatering in oil is conducted under the application of a pressure of 1 to 40 atmospheres (preferably, 2 to 5 atmospheres) and under heating to a temperature of 100° C. to 250° C. (preferably, 120° C. to 160° C.). In the evaporator 7, the raw material slurry is heated to the boiling point of water or more as described above and, as a result, moisture is removed and a nonvolatile component contained in low-rank coal is extracted with a solvent oil contained in the raw material slurry. Thus, a nonvolatile component contained in low-rank coal is extracted and the nonvolatile component functions as an alternative to a heavy oil. Accordingly, as described above, the amount of a heavy oil added can be reduced.

Thus, the raw material slurry is transported to the gas-liquid separator 5 and water in the raw material slurry is removed in the form of moisture in the gas-liquid separator 5. After the separation of moisture, the slurry is drawn through the bottom and transported toward the centrifugal separator 10 by a pump 6. A portion is branched at an intermediate position of a transportation line, heated by being passed through the evaporator 7, and then transported back to the gas-liquid separator 5. The pressure of a vapor-phase fraction obtained by subjecting moisture generated in the evaporator 7 to gas-liquid separation is increased by being passed through a compressor 8 and the resultant thermal energy is used to heat the slurry in the evaporator 7 to thereby dewater the slurry in oil. The vapor-phase fraction is subsequently transported to the preheater 3, used as a preheating source for the raw material slurry, and then subjected to oil-water separation in an oil-water separator 9. The resultant water is discarded. The oil collected in the oil-water separation is returned to the mixing tank 1 and reused.

In the dewatering step, since a dewatering treatment is conducted, the raw material slurry is required to be heated to the boiling point of water or more. In addition, since it is necessary to extract and extract a nonvolatile component with a solvent oil contained in the raw material slurry, the raw material slurry is preferably heated to 100° C. or more. To evaporate water at normal pressure, heating at least to 100° C. is required. However, to reduce the size of an apparatus, operation may be performed at a pressure higher than normal pressure. As a result, vapor-phase volume is reduced. To make the size of a compressor be reasonable, process may be performed at a pressure higher than normal pressure. When the pressure is increased, since the boiling point of water increases, the heating temperature needs to be made 100° C. or more. For example, when operation is performed under pressurization at 0.4 MPa, heating to 145° C. or more is required to evaporate water. However, when the temperature is increased to an unnecessarily high value, not only water but also a solvent oil evaporates. In the process, evaporation of a solvent oil needs to be reduced as much as possible. Accordingly, it is reasonable to perform operation at a temperature about several degrees centigrade higher than the boiling point of water at an operation pressure. Note that, in view of extracting a nonvolatile component of coal, a higher temperature is preferred.

The type of the evaporator 7 according to the present invention is not particularly restricted and various evaporators may be used: for example, a heating evaporator, a decompression evaporator, a heating-decompression evaporator, and the like. For example, a flash vaporization evaporator, a coil evaporator, a forced-circulation vertical-tube evaporator, or the like may be used. In general, for example, a forced-circulation evaporator equipped with a heat exchanger is preferably used.

As described above, in the dewatering step, water contained in low-rank coal is evaporated to thereby remove moisture and a nonvolatile component contained in the low-rank coal is extracted with a solvent oil contained in a raw material slurry.

3. Solid-Liquid Separation Step

As described above, after the water evaporation treatment is performed, the slurry having been subjected to the water evaporation treatment is transported to the solid-liquid separation section (mechanical separation) and subjected to solid-liquid separation with a mechanical solid-liquid separator. The type of such a mechanical solid-liquid separator is not particularly restricted and various separators may be used: for example, a centrifugal separator, a compressor, a settling tank, a filter, and the like. In the present embodiment, concentration with the centrifugal separator 10 is firstly performed and then compression with the screw press 11 is performed. However, only a centrifugal separator or a screw press may be used. Instead of a centrifugal separator, sedimentation may be employed. Instead of compression, vacuum filtration may be employed. An oil obtained by the solid-liquid separation may be returned as a circulation oil to the mixing tank 1.

The thus-separated solid matter (cake) is transported to the solid-liquid separation section (thermal separation) and heated in the dryer 12 under a carrier-gas flow to thereby evaporate the oil. As a result, a solid fuel is obtained.

In the thermal separation step, the surface of coal and pores of the coal are covered with a nonvolatile component. Specifically, while a solvent oil is evaporated, a nonvolatile component (heavy oil) contained in the coal is not evaporated and hence remains on the surface of the coal and in pores of the coal.

The drying is preferably performed by a fluid-bed process or a rotary dryer process. The oil that is transported and separated with a carrier gas may be fed to a condenser 13, collected as an oil, and then returned as a lubricating oil to the mixing tank 1.

As described above, in the solid-liquid separation step, a slurry is subjected to solid-liquid separation with a mechanical solid-liquid separator and an oil contained in the solid matter is evaporated with a dryer. As a result, a solid fuel in the form of a powder can be obtained.

4. Briquetting Step

The thus-obtained solid fuel in the form of a powder is transported from the dryer to the briquetting section and briquetted with a briquetting device (not shown) into a briquetted solid fuel. Examples of such a briquetting device include a tableting device (tableting) and a double-roll briquetting device (roll press). In general, a double-roll briquetting device is preferably used. In the briquetting step, a briquetted solid fuel can be produced.

According to the above-described method, although the amount of a heavy oil added is reduced, spontaneous combustion can be suppressed as in the cases where a heavy oil is added and the strength of briquetted solid matter can be enhanced.

EXAMPLES

Example 1

Regarding Properties of Nonvolatile Component Contained in Low-Rank Coal

It has been reported that, when coal is dewatered in oil, by making a nonvolatile heavy oil such as asphalt be present with the coal, asphalt effectively adheres to pores of the coal and spontaneous combustion is suppressed (Japanese Patent No. 2776278).

The inventors of the present invention have considered that, since a nonvolatile component that is a portion of coal is dissolved in a high-temperature oil and extracted, the dissolved nonvolatile component functions as an alternative to asphalt.

Then, the solubility of a coal (Indonesian brown coal) in a high-temperature solvent oil (kerosene) was measured. The following procedures were employed.

1) Pulverized coal (the amount of particles having a diameter of 1 mm or more is 10 mass % or less) was mixed with kerosene in a round bottom flask at room temperature.

2) The round bottom flask was placed in a heater and the sample was gradually heated to 140° C. over 2 hours. At this time, to make the atmosphere in the flask be inert, nitrogen gas was supplied at 200 $cm^3$/min. In addition, at this time, water evaporated from the coal was drawn in the form of moisture from the top of the round bottom flask, condensed with a cooling tube, and drawn in the form of liquid (water) outside the system. The sample in the round bottom flask was held at 140° C. for an hour.

3) Subsequently, the sample in the round bottom flask was filtered under the application of a pressure (pressurized with a nitrogen gas at 0.1 MPa) in the high-temperature state to separate the sample into the solid phase and the liquid phase.

4) The separated liquid phase was temporarily cooled, then poured into a flask of distillation equipment, subjected to distillation under reduced pressure under conditions described below to evaporate and draw kerosene outside the system. An evaporation residue, that is, a coal nonvolatile component having been dissolved in kerosene was collected.

Pressure: 10 mmHg

Heating rate: 2° C./min

Final temperature: 159° C. (after the final temperature is reached, the temperature is maintained until generation of moisture stops: 60 minutes)

Figure 3:
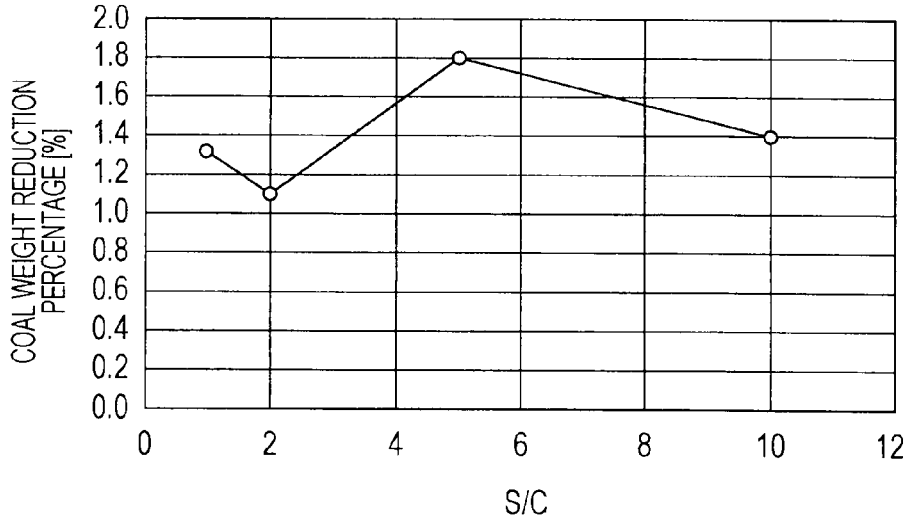
FIG. 3 is a graph about a coal nonvolatile component dissolved in kerosene.

FIG. 3 illustrates measurement results: s/c represents the ratio of the weight of kerosene charged to the weight of coal (having been dried); and coal weight reduction percentage represents the weight fraction of a component dissolved in kerosene with respect to the dry weight of the coal charged. As illustrated in FIG. 3, it has been found that at least 1% of a raw material coal dissolves in kerosene at 140° C.

For another coal, it has also been found that at least 1% of a raw material coal dissolves in kerosene at 140° C.

The coal component dissolving in kerosene was a nonvolatile heavy oil and had properties very similar to those of heavy oils such as asphalt that are added from the outside in existing techniques. Accordingly, it has been found that a low-rank coal improvement process can be achieved without adding a heavy oil from the outside.

Example 2

Regarding Process Flow

Figure 4:
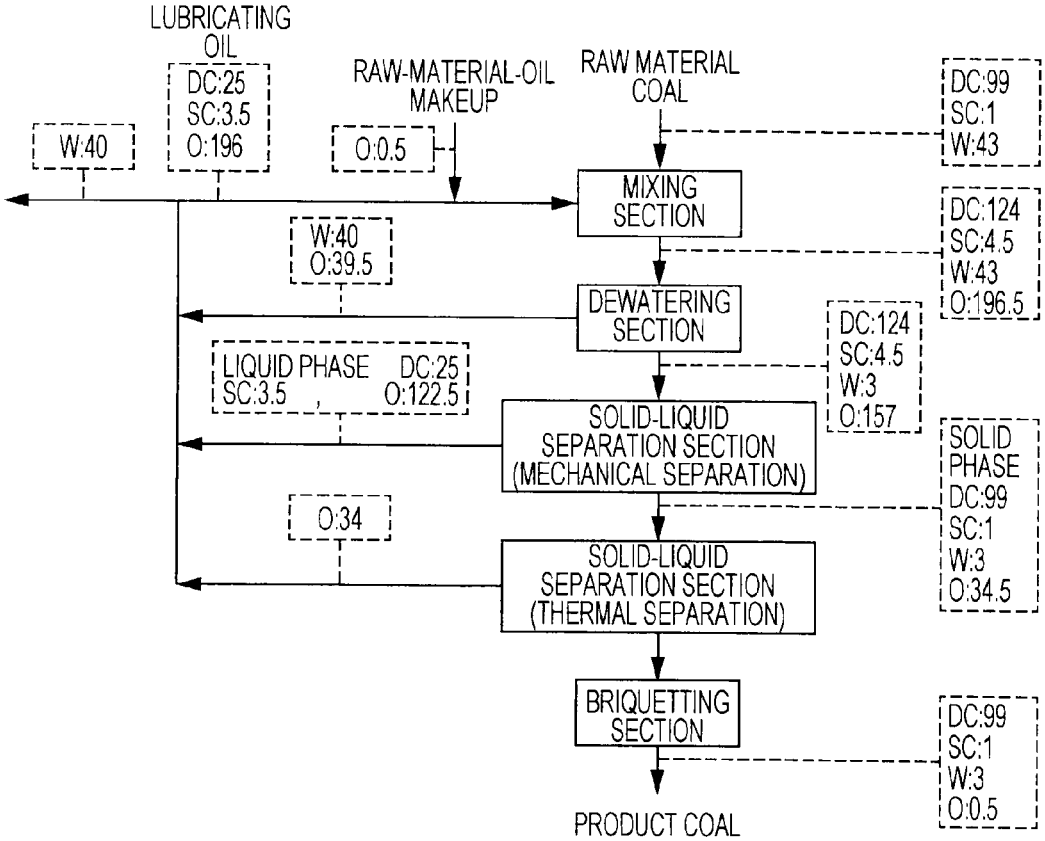
FIG. 4 illustrates a process flow in a steady state.

Next, FIG. 4 illustrates an example of a process flow in a steady state together with a material balance. The numeral values in FIG. 4 represent mass flow rate. DC represents dewatered coal; SC represents a nonvolatile component contained in coal; W represents water; and O represents kerosene. About 1% of a raw material coal can dissolve in kerosene and the concentration increases over time in circulating kerosene. In the dewatering section, 1% of coal dissolves in high-temperature kerosene. In the solid-liquid separation section (mechanical separation), a portion of kerosene remains on the surface and in pores of coal. The kerosene contains about 3% of a coal component that can dissolve in kerosene, that is, a nonvolatile component contained in coal. Thus, in the subsequent solid-liquid separation section (thermal separation), while kerosene is evaporated and separated, the coal nonvolatile component that can dissolve in kerosene remains on the surface and in pores of coal.

A heavy component (asphalt) is added in existing techniques for the purpose of suppressing spontaneous combustion of product coal. Accordingly, for example, the proportion of a mass component remaining in a product is made 1 mass %. Then, to provide another product having an equal quality, 1 mass % of a coal nonvolatile component that can dissolve in kerosene is made to remain in the product. To achieve this, the mechanical solid-liquid separation step (centrifugal separation) in FIG. 4 is performed such that, in the solid phase, the weight ratio of dewatered coal (DC) to a nonvolatile component (SC) that can dissolve in kerosene is 99:1. At this time, the mass ratio of the nonvolatile component to kerosene in the slurry supplied to the mechanical solid-liquid separation step (centrifugal separation) is 4.5:157, that is, about 3:100. Accordingly, when the ratio of dewatered coal to kerosene in the solid phase is made about 99:33 (99:34.5 in FIG. 4), the weight ratio of dewatered coal, kerosene, and the coal nonvolatile component is 99:33:1. For the solid phase containing kerosene, while most of the kerosene is evaporated and separated in the subsequent heating step (drying step), the nonvolatile component that can dissolve in kerosene is heavy and hence is not separated and remains on the surface of the coal. In a continuous centrifugal separator, parameters that mainly determine the capability of separating a solid phase and a liquid phase from each other are the number of revolutions and average residence time. The larger the number of revolutions and the longer the average residence time, the less the amount of a liquid phase remaining in a solid phase becomes. Continuous centrifugal separators are of various sizes and types and the number of revolutions and average residence time for achieving a desired solid-liquid separation capability vary and cannot be generally determined. However, in the present invention, by performing solid-liquid separation as described above, about 1 mass % of a nonvolatile component can be made to remain in dewatered coal and addition of a heavy oil can be preferably eliminated.

Example 3

Regarding Strength of Briquetted Solid Fuel

In an existing technique (Japanese Patent No. 2776278), at least 0.5 mass % of a heavy oil is added in a mass percentage with respect to dewatered coal.

Asphalt was selected as a heavy oil and a low-rank coal (Indonesian brown coal) was improved while an asphalt mass fraction (percentage with respect to dewatered coal) was varied. After that, solid fuels in the form of a briquette were produced with a double-roll briquetting device (K-205, manufactured by Furukawa Otsuka Co., Ltd.). The number of revolutions of the double-roll briquetting device was made 8 rpm. The strength was measured with a crush strength meter (XA-500, manufactured by Furukawa Otsuka Co., Ltd.).

The results are illustrated in FIG. 5. FIG. 5 is a graph illustrating the relationship between the mass fraction (percentage with respect to dewatered coal) [mass %] of a heavy oil (specifically, asphalt) and briquette strength [kg-wt]. The abscissa axis indicates the mass fraction (percentage with respect to dewatered coal) [mass %] of a heavy oil (specifically, asphalt). The ordinate axis indicates briquette strength [kg-wt]. As illustrated in FIG. 5, by making the adhesion amount of a heavy oil in a solid fuel be 0 to 0.5 mass %, the strength of a briquetted solid fuel can be made about 68 kg-wt to about 87 kg-wt. In particular, when the adhesion amount is 0 mass %, a briquetted solid fuel has the highest strength of about 87 kg-wt. When a briquetted solid fuel produces powder, the probability of the contact between active sites of the solid fuel and the air increases and there is a concern about the increase in the probability of spontaneous combustion. However, as described above, when the strength of a briquetted solid fuel is increased by making the adhesion amount of a heavy oil be 0 to 0.5 mass %, spontaneous combustion can be suppressed. From FIG. 5, it has been found that, the lower the asphalt mass fraction, the higher the briquette strength is; and, in particular, the highest strength is achieved at 0 mass % in which no asphalt is added. To increase the briquette strength, the adhesion between fine coal particles to be briquetted is preferably high. However, asphalt adheres to the surface of the coal and, as a result, the adhesion is probably degraded. Although the detailed mechanism is not clear, it can be considered that asphalt is petroleum-based (aliphatic series) and hence has low compatibility (adhesion) with coal (aromatic series).

The invention claimed is:

1. A method for producing a solid fuel, the method comprising:

pulverizing low-rank coal;

preparing a slurry by mixing the pulverized low-rank coal with a solvent oil;

evaporating water in the slurry by heating the slurry to a boiling point of water or more;

producing fine coal by separating the solvent oil from the slurry, while a non-volatile component contained in the low-rank coal is not evaporated by performing solid-liquid separating against the slurry; and briquetting the fine coal, wherein, by heating the slurry to the boiling point of water or more, a nonvolatile component contained in the low-rank coal is extracted with the solvent oil and the extracted nonvolatile component covers an outer surface of the low-rank coal and inner surfaces of pores of the low-rank coal, a content of the non-volatile component is made in about 1 mass % with respect to the solid fuel having been dried;

a content of a heavy oil added from outside is made less than 0.5 mass % with respect to the solid fuel having been dried; and in said solid-liquid separating the weight ratio of dewatered coal, kerosene, and the coal nonvolatile component in the solid phase is 99:33:1.

2. The method for producing a solid fuel according to claim 1, wherein the heavy oil is not substantially added.

3. The method of claim 1, wherein said solvent oil is a light boiling oil.

4. The method of claim 1, wherein said solvent oil is a petroleum oil having a boiling point of at least 100° C.

5. The method of claim 4, wherein said solvent oil is a petroleum oil having a boiling point of no more than 400° C.

6. The method of claim 1, wherein said solvent oil is kerosene.

7. The method of claim 1, wherein said low-rank coal is coal having a water content of at least 20 mass % with respect to the coal having been dried.

8. The method of claim 1, wherein said low-rank coal is selected from the group consisting of brown coal, lignite, and subbituminous coal.

9. The method of claim 1, wherein said low-rank coal is brown coal selected from the group consisting of Victoria coal, North Dakota coal, and Beluga coal.

10. The method of claim 1, wherein said low-rank coal is subbituminous coal selected from the group consisting of West Banko coal, Binungan coal, and Samarangau coal.

11. The method of claim 1, wherein said evaporating is conducted under the application of a pressure of 1 to 40 atmospheres and under heating to a temperature of 100° C. to 250° C.

12. The method of claim 11, wherein said pressure is from 2 to 5 atmospheres.

13. The method of claim 11, wherein said temperature is from 120° C. to 160° C.

14. The method of claim 1, wherein said separating is mechanical solid-liquid separation with a mechanical solid-liquid separator.

15. The method of claim 14, wherein said mechanical solid-liquid separator is selected from the group consisting of a centrifugal separator, a compressor, a settling tank, and a filter.

16. The method of claim 1, wherein said briquetting is with a briquetting device.

17. The method of claim 16, wherein said briquetting device is a tableting device or a double-roll briquetting device.

* * * * *